US005471798A

United States Patent [19]

Kuhns

[11] Patent Number: 5,471,798

[45] Date of Patent: Dec. 5, 1995

[54] RAIN GUTTER COVERS AND ROOF LINE PROTECTORS

[76] Inventor: Richard L. Kuhns, 210 Broad St., Red Bank, N.J. 07701

[21] Appl. No.: 249,731

[22] Filed: May 26, 1994

Related U.S. Application Data

[63] Continuation-in-part of Ser. No. 32,270, Mar. 17, 1993, Pat. No. 5,339,575, which is a continuation of Ser. No. 780,906, Oct. 23, 1991, Pat. No. 5,216,851.

[51] Int. Cl.[6] ..... E04D 13/00

[52] U.S. Cl. ..... 52/12; 52/11

[58] Field of Search ..... 52/11–16, 12

[56] References Cited

U.S. PATENT DOCUMENTS

| | | | |
|---|---|---|---|
| 4,411,110 | 10/1983 | Carey | 52/11 |
| 4,447,994 | 5/1984 | Garneau | 52/11 |
| 4,455,791 | 6/1984 | Elko | 52/12 |
| 4,616,450 | 10/1986 | Shouse | 52/12 |
| 5,010,696 | 4/1991 | Knittel | 52/12 |
| 5,099,620 | 3/1992 | Carey | 52/12 |
| 5,305,562 | 4/1994 | Sapia | 52/12 |

*Primary Examiner*—Carl D. Friedman

*Assistant Examiner*—Beth A. Aubrey

*Attorney, Agent, or Firm*—Thomason & Moser

[57] ABSTRACT

A covering and protector for a rain gutter that prevents the gutter from becoming clogged with leaves or other debris. The covering protector is designed so that leaves (for example) and other debris which may clog the gutter can neither enter the gutter nor clog the protector, the openings in the protector which permit rain to pass into the gutter being vertically disposed. A unitary sheet includes an extended flat portion which does not contain any apertures therein which functions as a closed top portion for covering the open top of the existing gutter and which also serves to interfit under and between existing roofing materials (such as roof shingles) to provide for secure fastening to the roof as well as to provide an uninterrupted smooth path for rainwater to travel off the roof. The top portion is connected to an apertured vertical portion containing a number of apertures each with a flap for directing rain into the rain gutter. A flange extending from the edge of the vertical portion interfits beneath or on top of the upper lip of a front wall of the existing rain gutter and serves both to close the gutter at its front wall and to provide a surface for fastening the cover invention to the existing rain gutter. A plurality of secondary apertures each having a flap for directing rainwater from the flange into the rain gutter and being formed at the junction of the flange and the vertical portion.

9 Claims, 5 Drawing Sheets

RAIN GUTTER COVERS AND ROOF LINE PROTECTORS

CROSS-REFERENCE TO RELATED APPLICATIONS

This application is a continuation-in-part of application Ser. No. 08/032,270, filed Mar. 17, 1993, now U.S. Pat. No. 5,339,575, which in turn is a continuation application of application Ser. No. 7/780,906, filed Oct. 23, 1991, now U.S. Pat. No. 5,216,851.

BACKGROUND OF THE DISCLOSURE

1. Field of Invention

This invention relates to a covering and protector for existing rain gutters and roof-lines. The purpose of this invention is to cover the gutter to prevent the gutter from becoming clogged by leaves and other debris and to protect the roof-line from ice and snow damage. The covering protector of this invention is designed as one integral unit so that leaves, for example, and other debris which may clog the gutter can neither enter the gutter nor clog the protector, the openings in the protector which permit rain to pass into the gutter being horizontally disposed. The invention also prevents ice and snow from coming into contact with the wood portion of the roof where possible ice and rot damage can occur.

2. Description of the Background Art

U.S. Pat. No. 4,411,110 (the disclosure of which is hereby incorporated by reference) describes a rain gutter assembly which is configured to form a closed top surface which is mounted so that it is downwardly slanted to a rounded corner. The assembly then extends vertically downwardly forming a front wall having a plurality of specially configured apertures therein. Each aperture includes a generally inwardly and downwardly extending flap provided along the top edge of the aperture for receiving and directing rain water into the gutter. The assembly then extends horizontally to form a bottom gutter surface and then upwardly to form a back wall. The ends of the back wall and of the downwardly slanted top surface are fastened to each other to close the gutter and to affix the gutter in its desired location. The present invention solves several problems associated with the design shown in this patent.

Although the two upward extending collars where the rear portion of the gutter and the top covering of the gutter meet are affixed to the fascia board, and protect the fascia board from water being blown on it, the collars do not protect the plywood or wood portion of the roof itself from coming into contact with ice and snow. In wintertime, snow may be blown onto the top portion of the covering and the adjacent roof portion and may otherwise accumulate on the top of the covering and roof. This snow can turn to ice and damage the roof. Warmer temperatures within the structure in combination with colder outside temperatures creates a pressure differential so that, as the ice in contact with the wood portion of the roof melts (due to higher temperatures within the structure), the water is drawn into the pores of the wood in an osmotic process which results in rotting of the wood portion of the roof near the gutter line. The rotting wood leads to water leaks into the structure necessitating costly roof repairs or premature replacement of the entire roof. The moist environment also contributes to infestation by carpenter ants which cause further destruction of rafters, fascia and soffits.

A further problem with the rain gutter assembly described in the '110 patent occurs when the structure is subjected to wind driven rainfall in certain directions and velocities. Some of this wind driven rainfall bypasses the patented protector causing streaking of the front surface of the gutter and then falling directly to the ground. The streaking is unsightly and the falling water leads to safety problems.

U.S. Pat. No. 4,404,775 describes protective coverings which are "deflector" type devices having a flat portion which is affixed to the roof itself (either on top of the shingles or slid beneath the shingles) and a lower arcuate surface which is mounted above the lip of the gutter. In principle, water coming from the roof will flow onto the top flat portion of the deflector device following its path to the arcuate surface where, in accordance with principles of surface adhesion, water will adhere to the surface and be delivered into the gutter as the debris carried by the water is jettisoned off the arcuate surface. However, difficulties ensue because of how the arcuate portion of the deflector device is attached to the gutter and held in place. Typically, clips such as shown in U.S. Pat. No. 4,796,390 are used to hold the deflector device of the '775 patent in position above the gutter. The bracket consists of a lower portion which has a reversed direction to the upper curve and is designed to rest on the upper edge of the outside wall of the gutter being affixed via tabs to the inside lip of the gutter. The bracket is then secured to the gutter by bending the bracket down the outside wall of the gutter thus pulling the tab tight to the inside lip of the gutter.

The difficulty with brackets of this type is that they are not fully stationary at the gutter-bracket juncture. Thus, the top edge of the flat portion of the deflector device must be made stationary to the roof via a combination of adhesive strips and by placing nails into the roof to prevent horizontal and/or vertical movement from wind and storms which could cause the deflector device to be blown off the gutter. The drawbacks are that the adhesive strip increases the cost and time required for installation and the nail (which is required to make the panel stationary), simply introduces one more place on each panel (typically in 3 to 5 foot lengths) where water can enter through the shingles into the roof possibly causing in-wall leaks and damage to the roof, itself.

Further problems with deflector devices arise because the lower portion of the device, below the arcuate portion nearest the gutter lip, leaves an approximately ⅜" to ½" horizontal open edge along the entire length of the gutter. Though in theory the debris is to be jettisoned away, this does not occur in practice. As much as 50% of the debris which is washed over the arcuate portion of the covering clogs this opening or enters the horizontal opening thus clogging the gutter. This requires that the protector device be periodically removed from the gutter and downspouts, necessitating removal and replacement of fasteners and nails which removal and replacement further increases the likelihood of creation of water pathways through the shingles into the structure itself.

A still further problem with deflector devices of the type discussed above is with certain types of trees such as oak trees, the falling debris in the springtime hangs over the roof and the protective covering device. Further, heavy rain causing debris to be washed over the arcuate surface of the protector does not jettison the debris, but rather results in the debris adhering to the protector. In heavy tree cover, the debris is sufficient to clog the apertures of the device shown in the '110 patent or close off longitudinal horizontal opening of the protectors in the '775 patent. Rainwater bypasses the protector, runs over the outer edge of the rain gutter and onto the ground. Unsightly streaking of the gutter occurs and water dripping onto the ground may result in hazardous conditions from icicles, icing or a loosening of the gutter because of the weight of the ice.

It is desirable to provide a means to remove debris from the front surface of the protector. A brush on a telescopic pole is employed to avoid the need for a ladder. However, when such a brush is used with the prior art protectors, the debris are usually caused to be knocked through the longitudinally horizontal surface and into the gutter.

SUMMARY OF THE INVENTION

The present invention overcomes the disadvantages heretofore associated with the prior art. Specifically, the present invention is an improved gutter cover that is a unitary sheet constructed of metal, such as aluminum, or heavy vinyl. This unitary sheet is formed to have an extended flat portion (a top portion) which is designed to interfit under and between existing roofing materials (such as roof shingles). As such, the top portion is oriented substantially horizontal to be securely fastened to the roof and position a portion of the gutter cover above a conventional rain gutter. This orientation provides an uninterrupted smooth path for rainwater to travel off the roof and onto the flat portion.

The top portion connects to an upper edge of a substantially vertical front portion containing a plurality of apertures. The apertures are typically arranged in rows. Each aperture is generally rectangular in shape and contains a flap or a fin. The flap is connected to an upper edge of the aperture and projects inwardly toward the rain gutter. Due to surface adhesion phenomenon, rain water flowing over the front portion adheres to the flaps and is channeled into the rain gutter.

A lower edge of the vertical portion connects to a substantially horizontal flange that is designed to interfit with a lip of a conventional rain gutter. The flange is attached intermittently by fasteners, such as sheet metal screws. The flange may be attached to either the top or underside of the lip. Alternatively, the flange may be snap-fit against the lip forming a seal between the lip and the flange.

To facilitate collecting, in the rain gutter, any rain water that is not directed into the gutter by the flaps, the gutter cover contains a plurality of secondary apertures. These secondary apertures are located at a point where the vertical portion meets the flange, e.g., along the lower edge of the vertical portion. Each secondary aperture is partially formed in the vertical portion and partially formed in the flange. To direct the rain water into the rain gutter each aperture contains a flap connected to the bottom edge of each aperture. Thus, through surface adhesion, the rain water which is not directed into the gutter by the primary apertures will be directed into the gutter by the secondary apertures.

The covering of this invention is fastened to the gutter by joining the flange portion of the invention to the lip on the front wall of the gutter, and the top portion to the roof of the dwelling or other building where the existing gutter is used. End portions of the existing gutter are covered by securing together the top portions of the invention thus creating an apertured wall at the end of the gutter and by securing the flange of the invention to a top flat portion of the end cap of the existing gutter.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF THE INVENTION

Figure 1:
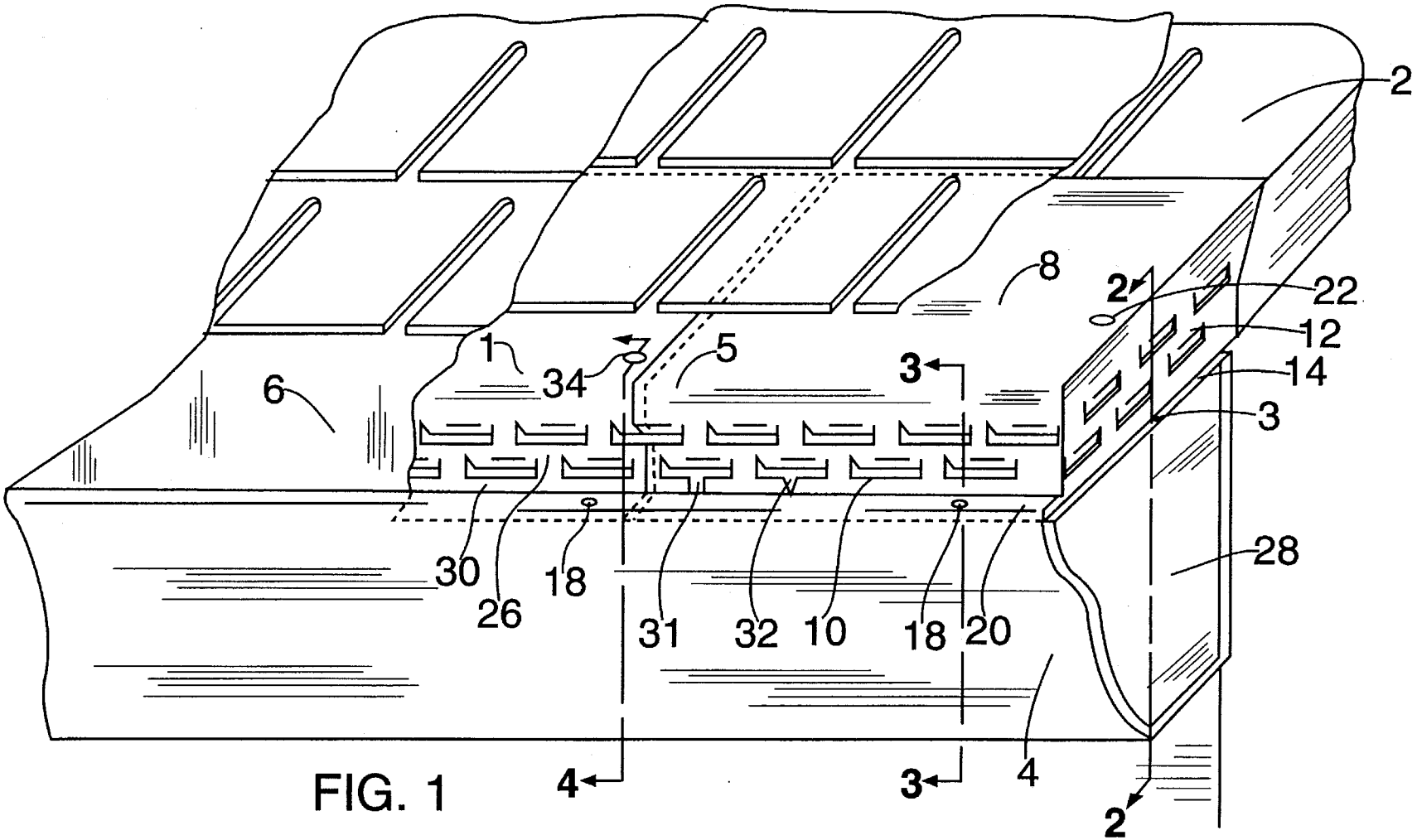
FIG. 1 is a perspective view of a first embodiment of my invention.

FIG. 1 is a perspective view of the preferred embodiment of the present invention. In FIG. 1, the roofing shingles of a building such as a dwelling house is denoted by the numeral 2. As is standard practice, a rain gutter 6 of the usual type is attached to the building adjacent the roof. This gutter 6 usually has an open top as shown in the left hand portion of FIG. 1.

Figure 2:
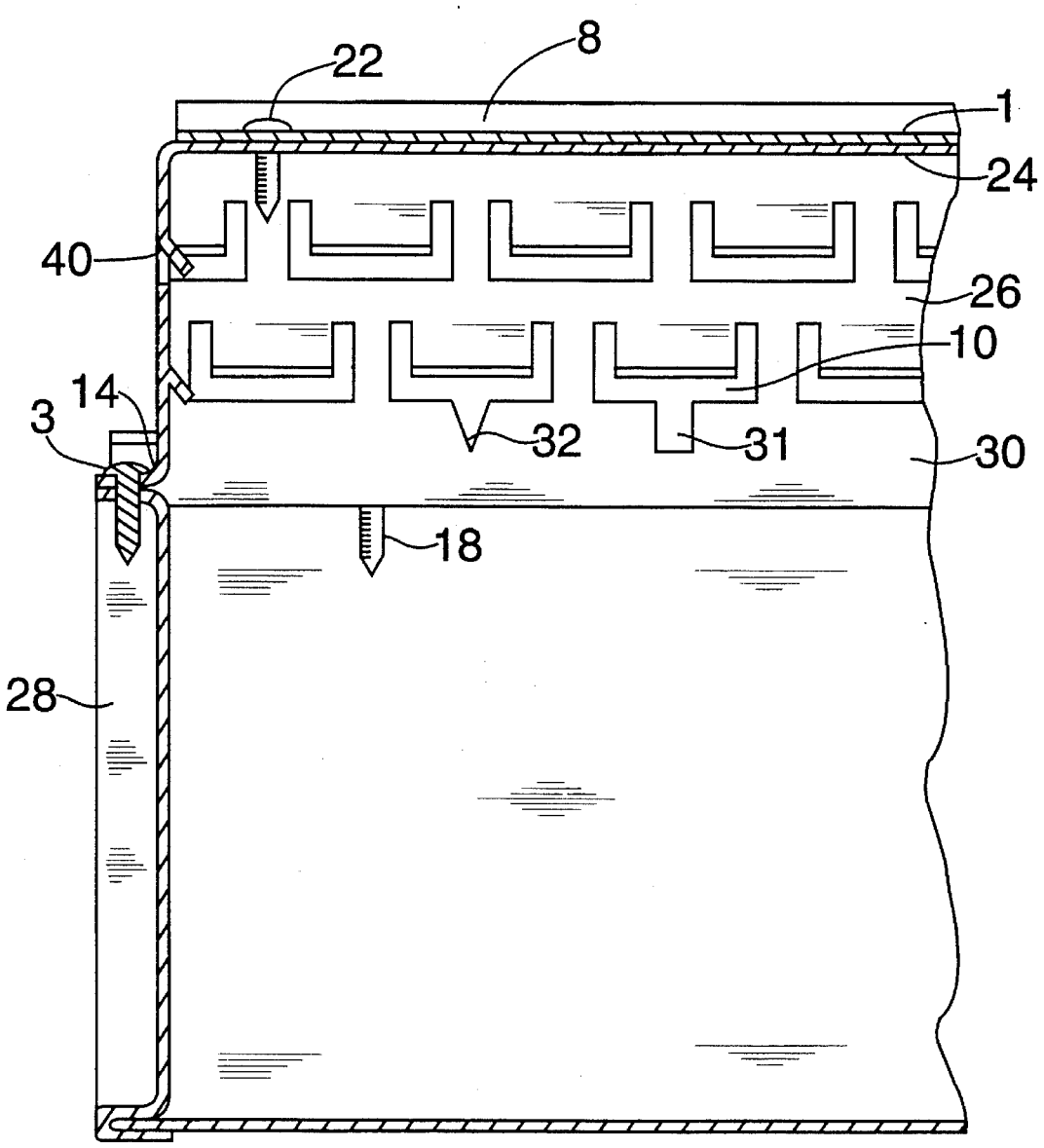
FIG. 2 is a sectional view of the first embodiment of my invention taken along the line 2—2 of FIG. 1.
Figure 3:
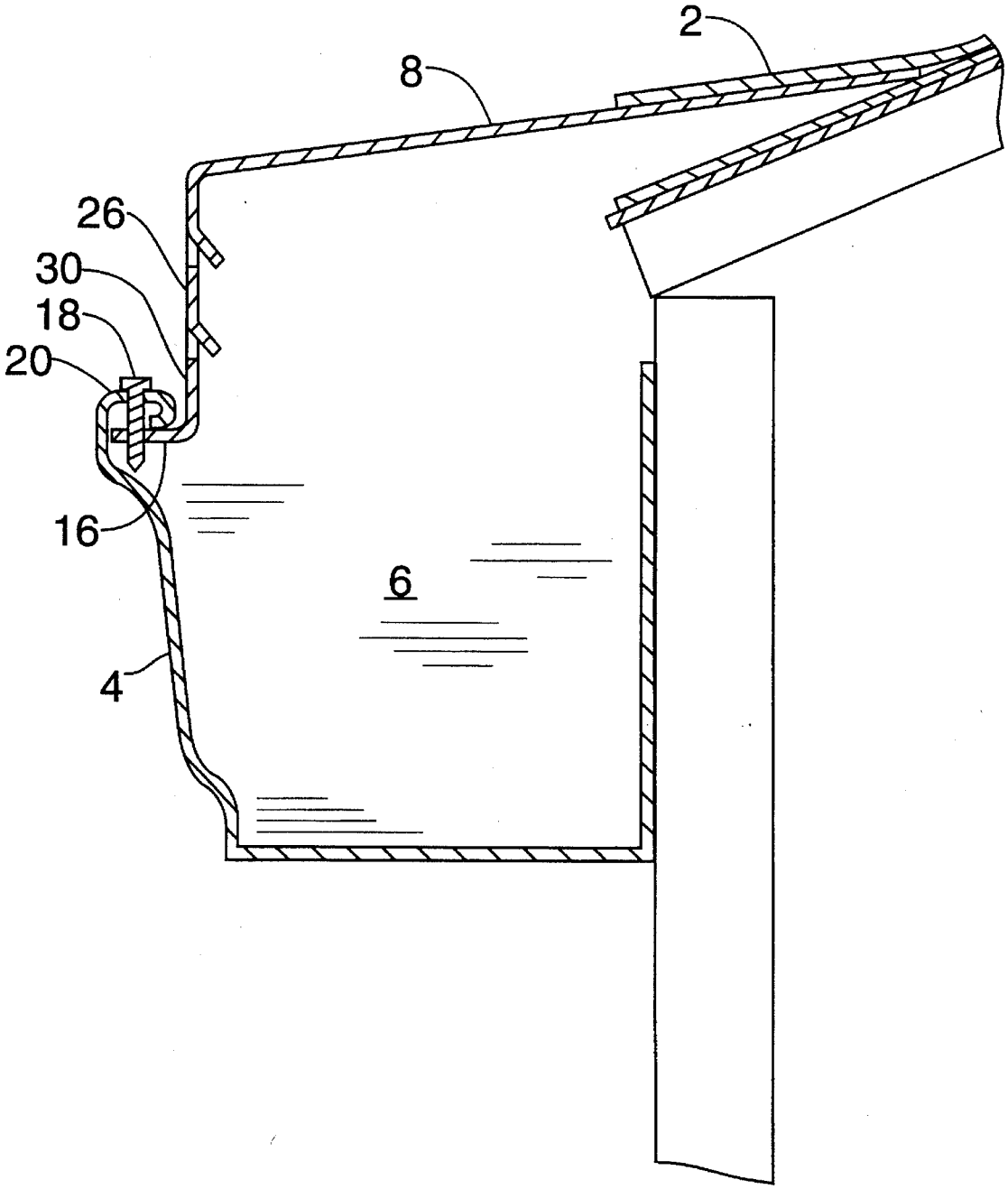
FIG. 3 is a sectional view of the embodiment of the invention taken along the line 3—3 of FIG. 1.

In accordance with the invention, as shown in FIGS. 1–3, a covering and protector for the open rain gutter is shown generally at numeral 8. This protector has a closed top portion 1 and an apertured vertical front portion 26. The vertical front portion 26 may contain one or more rows of a plurality of apertures 10 of, for example, the type disclosed in the aforementioned '110 patent, e.g., each aperture contains a flap, connected to the top of the aperture, that extends inwardly toward the rain gutter. Beneath the lowermost row of apertures 10, vertical front portion 26 also contains a wall portion 30. This wall portion 30 may contain a plurality of slits 31 or slots 32 which enhance the seepage of water into the gutter.

The end of the vertical portion 30 terminates in a flange 16 (shown in more detail in FIG. 3). This flange 16 interfits beneath the inner edge of the lip 20 in the upper facing wall 4 of the gutter 6. The wall portion 30 serves several purposes in my invention. First, the wall portion 30 prevents debris which collects on the lip from falling into the gutter. Secondly, the wall portion 30 prevents debris from entering the gutter while the invention is being brushed or otherwise serviced during use. The covering is connected to the gutter via the flange 16 on the covering and lip on the gutter. This connection also prevents debris from passing into the gutter 6. The flange 16 and the lip 20 also provide the location for fastening the invention to the gutter 6 as by sheet metal screws 18, for example.

As is also customary, rain gutters 6 have end portions 28 thereon to close off the trough formed interiorly of the rain gutter. These end portions are characterized by an absence of the lip portion 20. As shown in FIGS. 1 and 2, I modified the portion of my invention used to overfit and mate with these end portions 28. The end portions of my invention shown generally at 12 also contain the apertures of the type used in front panel 26. The vertical parts of the end portions of the invention containing these apertures terminate in an outwardly extending flange 14 designed to overfit and seal onto the top of the end portion 28 of the gutter 6. These end portions have a closed flattened portion 24 which fit beneath the covering portion 1. Fasteners such as sheet metal screws 22 or rivets connect the end portion to the remainder of the covering protector of the invention. Additional fasteners represented by sheet metal screws 3 in FIG. 2 can be used to fasten the connecting lip 14 to the top of the gutter end portion 28.

As best shown in FIG. 3, the closed covering portion 8 extends so as to interfit beneath a layer of the existing roofing shingles 12 so as to provide a relatively uninterrupted and continuous path for rain to flow from the roof to covering protector of the invention.

I have found that, for the embodiment shown in FIGS. 1–3, it is preferable to intermittently affix the flange to the under portion of the gutter to provide an additional pathway for any water which bypasses the apertures to then enter the gutter through inherent openings between the bottom of the flange and the top lip of the gutter. The flange of the protector is a minimum of ⅙" wider than the lip of the gutter thus providing a channel for any water which bypasses the apertures to be distributed to the inherent openings between the flange and the top lip of the gutter through which the small quantities of water can seep into the gutter. These openings are too small to permit any debris to enter the gutter. A preferred width of flange is ¼" wider than the top lip of the gutter though it could be as much as 1" or more wider than the top lip of the gutter.

Figure 4:
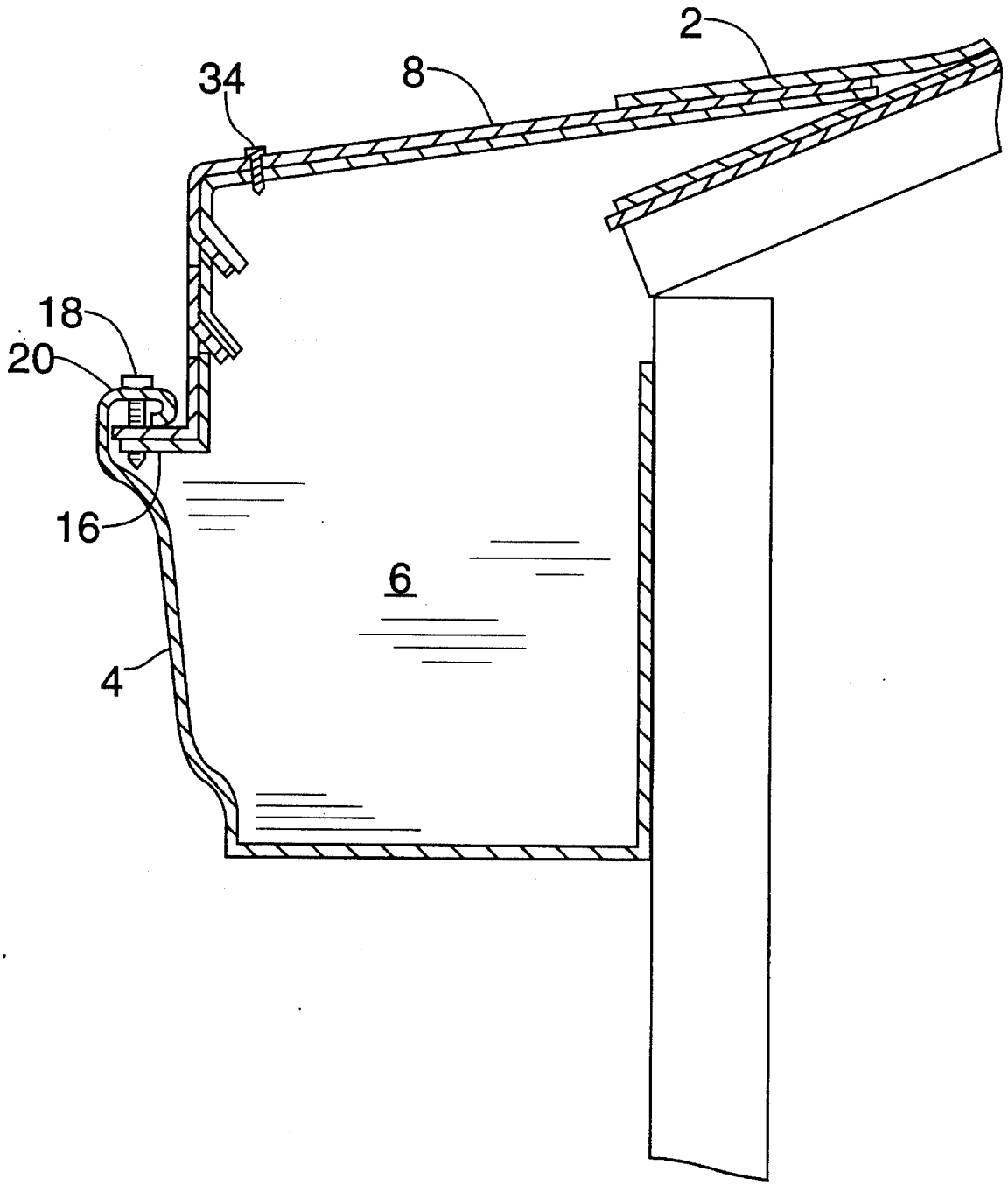
FIG. 4 is a perspective view of a portion of a second embodiment of my invention.

As shown in FIG. 1, my invention may be formed in a single unitary sheet or, as shown in FIG. 4, it may be formed in sections. These sections when installed on the rain gutter, may be overlapped at juncture 5 and joined together with sheet metal screws 34 or similar fasteners.

In installations shown in FIG. 1, the end of the gutter is flush with the end of the roof/dwelling. Where the existing gutter extends beyond the end of the roof/dwelling, I have found it desirable to block off the space created between the end of the gutter and the dwelling with a solid piece of material fastened to the protector of my invention to prevent debris from entering the gutter from the rear.

Figure 5:
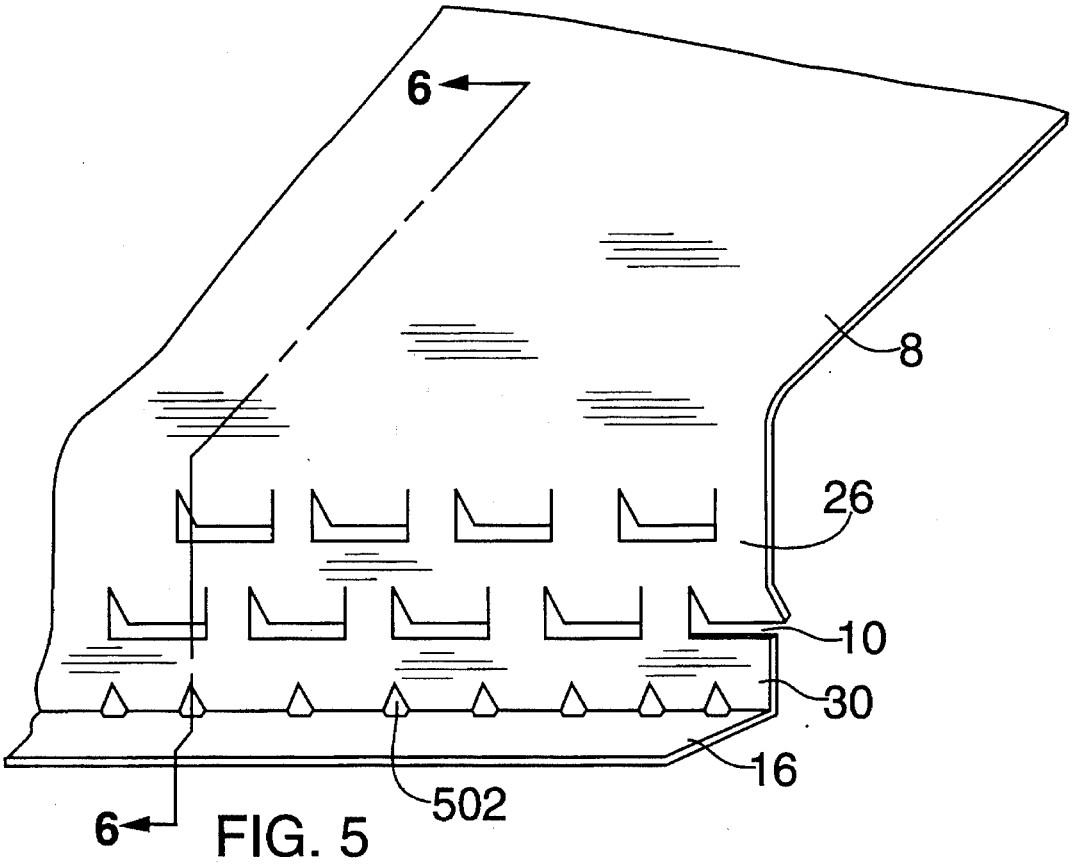
FIG. 5 is a perspective view of a portion of a third embodiment of my invention.
Figure 6:
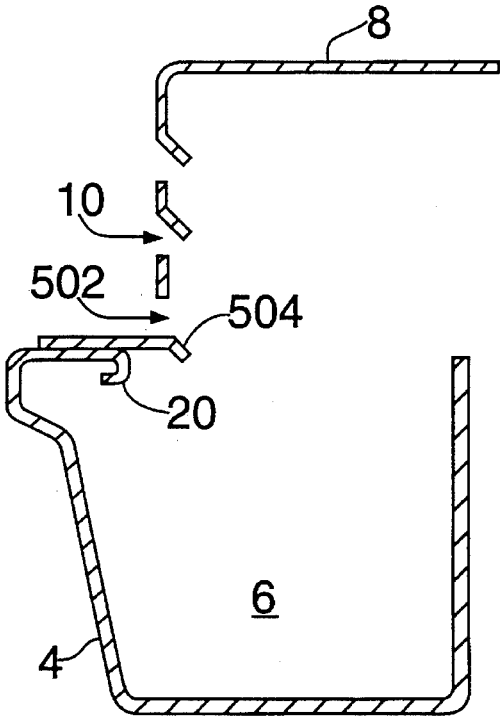
FIG. 6 is a sectional view of the third embodiment of the invention taken along line 6—6 of FIG. 5.

FIGS. 5 and 6 depict another embodiment of my invention that includes a plurality of secondary apertures 502. By including these secondary apertures, the flange can be attached either above or below the lip of the rain gutter. As such, the inventive gutter cover is easily installed to the top edge of the gutter lip even if that lip is damaged or deformed in some manner. Also, this embodiment of the invention can be installed upon wooden gutters which typically do not have a lip.

Additionally, the flange can be snap-fit and sealed to the lip of the gutter. Importantly, even though the flange is sealed to the lip, any rain water not directed into the rain gutter by the primary apertures in the vertical portion is directed into the rain gutter by the secondary apertures.

Specifically, the secondary apertures are formed in the wall portion 30 below the lower most row of primary apertures 10. Specifically, the secondary apertures are located where the front portion 26 attaches to flange 16 such that the secondary apertures are formed in the wall portion 30 proximate to the flange 16. Preferably, each secondary aperture has a triangular shape with an apex of the triangle formed in the front portion and a base of the triangle formed in the flange. Additionally, the base of each secondary aperture has a flap that extends inwardly to direct rain water from the flange into the rain gutter 6. To enhance the rain water flow into the secondary apertures, the flange may be slightly inclined in the direction away from the secondary apertures.

Although the embodiment of the invention shown in FIGS. 5–6 contains triangular-shaped secondary apertures, those skilled in the art will realize that the secondary apertures can be of any shape, including square, rectangular, and the like. Furthermore, the secondary apertures are shown formed in wall portion 30; however, they may be spaced apart from one another such that the top of each aperture extends between the primary apertures.

It will be apparent that modifications may be made to the invention without departing from the spirit and scope of the invention; accordingly, what is sought to be protected is set forth in the appended claims.

What is claimed is:

1. A rain gutter cover for being mounted above a rain gutter and for preventing entrance into the rain gutter of leaves and other debris which cause rain gutter clogging, where said rain gutter is an elongated trough defined by a front wall, a bottom portion and a rear wall, said rain gutter being attached to a building adjacent a bottom edge of a roof upon which rain falls, said rain gutter cover comprising:

a generally angular top portion, a substantially horizontal flange, and a substantially vertical front portion intermediate and interconnecting said top portion and said flange;

said angular top portion mounts adjacent said bottom edge of said roof and transfers rain from said roof to said vertical front portion;

said vertical front portion provided with a plurality of apertures therein for receiving rain flowing downwardly across said front portion and for diverting rain into the rain gutter, wherein said apertures are of a predetermined size sufficiently small to generally prevent leaves and other debris from entering said rain gutter;

said horizontal flange extends from said substantially vertical front portion to said front wall of said rain gutter, a connection line is defined by the intersection of said horizontal flange and said vertical front portion;

said front wall of said rain gutter contains a lip to which said flange is attached; and a plurality of secondary apertures, formed in said front portion, having a flap extending inwardly from a bottom edge of each of said secondary apertures toward said rain gutter, where said bottom edge of each of said secondary apertures is coincident with said connection line.

2. The rain gutter cover of claim 1 wherein said plurality of apertures in said vertical front portion is positioned within said vertical front portion such that the plurality of apertures is spaced a predefined distance from said connection line.

3. The rain gutter of claim 1 wherein said plurality of apertures is arranged in a plurality of horizontally disposed rows of interrupted slots, the interruptions between the slots in each row being displaced horizontally with respect to the interruptions between the slots of any adjacent row of slots such that there is no generally vertical path of rain flow downwardly across said substantially vertical front portion which is not interrupted by at least one of said slots.

4. The rain gutter cover of claim 3 wherein each of said slots contains a top and bottom edge, and a flap, connected to said top edge, extends inwardly toward said rain gutter rear wall from said top edge of each of said slots such that rain flowing downwardly across said substantially vertical front portion is directed into said rain gutter by said flap.

5. The rain gutter cover of claim 1 wherein said flange extends beneath said lip and said flange is intermittently attached along a length of said rain gutter to said lip of said rain gutter by fastening means.

6. The rain gutter cover of claim 1 wherein said flange extends above said lip and said flange is intermittently attached along a length of said rain gutter to said lip of said rain gutter by fastening means.

7. The rain gutter cover of claim 1 wherein said flange is snap-fit to the lip to substantially seal said lip to said flange.

8. The rain gutter cover of claim 1 wherein each of said secondary apertures have a substantially triangular shape with a base edge formed in said flange and an apex in said front portion, said flap is attached to said base edge.

9. The rain gutter cover at claim 1 wherein said flange is inclined as the flange extends in a direction away from the secondary apertures.

* * * * *